United States Patent [19]

Cloud et al.

[11] Patent Number: 4,503,976

[45] Date of Patent: Mar. 12, 1985

[54] ENVELOPE TRACKING SYSTEM FOR MAIL SORTING MACHINES

[75] Inventors: Wilbert L. Cloud, Grandview, Mo.; Steve Shaw, Lenexa, Kans.

[73] Assignee: Bell & Howell Company, Chicago, Ill.

[21] Appl. No.: 428,714

[22] Filed: Sep. 30, 1982

[51] Int. Cl.[3] ..... B07C 3/06; B07C 5/36

[52] U.S. Cl. ..... 209/546; 209/564; 209/584; 209/900

[58] Field of Search ..... 209/546, 548, 549, 562–566, 209/569, 583, 584, 900; 235/474

[56] References Cited

U.S. PATENT DOCUMENTS

| | | | |
|---|---|---|---|
| 3,141,540 | 7/1964 | Burkhardt | 209/566 |
| 3,343,672 | 9/1967 | De Vries et al. | 209/566 X |
| 3,363,756 | 1/1968 | Dykaar et al. | 209/564 X |
| 3,420,368 | 1/1969 | Rosenberg et al. | 209/566 |
| 3,574,328 | 4/1971 | Holmes | 209/566 |
| 3,645,392 | 2/1972 | Chittenden et al. | 209/565 |
| 3,889,811 | 6/1975 | Yoshimura | 209/566 X |
| 3,904,516 | 9/1975 | Chiba et al. | 209/566 |
| 4,124,121 | 11/1978 | Sung et al. | 209/583 |
| 4,251,000 | 2/1981 | Templeton | 209/566 |
| 4,432,458 | 2/1984 | Daboub | 209/564 |

FOREIGN PATENT DOCUMENTS

| | | | |
|---|---|---|---|
| 477823 | 6/1975 | Austria | 209/584 |

*Primary Examiner*—Robert B. Reeves
*Assistant Examiner*—Edward M. Wacyra
*Attorney, Agent, or Firm*—Kokjer, Kircher, Bradley, Wharton, Bowman & Johnson

[57] ABSTRACT

An improved envelope tracking and control system for a mail sorting machine of the type which reads a sorting code imprinted on each envelope and deposits the envelope in the proper sorting bin by deflecting a diverter gate associated with the bin. Each diverter mechanism has two sets of photo sensors which sense the presence of an approaching envelope. Tracking circuitry processes the sort code obtained from the envelope and transfers the processed data to the tracking circuit for the next diverter if the data does not coincide with a code that has been preassigned to the diverter. The processed data is held in a latch circuit and is passed on only if the envelope is sensed by the second set of photo sensors. If there is coincidence of the data, a one shot pulse applied to a solenoid deflects the appropriate gate for a predetermined time period that avoids possible damage to the solenoid or to the circuit components. Existing components are used in a self test system which includes an astable oscillator that simulates successive envelopes passing through the machine.

10 Claims, 3 Drawing Figures

ENVELOPE TRACKING SYSTEM FOR MAIL SORTING MACHINES

BACKGROUND AND SUMMARY OF THE INVENTION

This invention relates generally to mail sorting equipment and more particularly to an improved electronic tracking circuit for monitoring and controlling the movement of envelopes in a mail sorting machine.

The type of mail sorting machine in which the tracking circuit of this invention is used includes a conveyor which transports envelopes one at a time past a read station. At the read station, a reader scans the envelopes and reads a code such as a zip code or bar code provided on each envelope. The code which is read from each envelope is processed into a form that can be compared with codes that have been pre-assigned to the sort bins of the machine. Each envelope is transported along the machine until it reaches the appropriate bin, as determined by coincidence between the code of the envelope and the code assigned to the bin. A gate is then deflected by a solenoid to intercept the envelope and direct it into the sort bin located adjacent to the deflected gate.

One type of control circuit that has been proposed for tracking the progress of the envelopes along the machine and diverting them into the sort bins is shown in patent application Ser. No. 974,074, filed Dec. 28, 1978 in the name of Henry A. Daboub, now abandoned. Although this type of tracking system has functioned in a generally satisfactory manner for the most part, it has not been entirely free of problems.

For example, during a jam situation involving jamming of one or more envelopes in the machine, there can be a condition where a solenoid remains energized for an extended period of time, thus subjecting the solenoid and/or the tracking circuitry to possible damage. Also, trouble shooting and testing of tracking systems involves considerable difficulty and time consumption, due primarily to the complexity of the circuitry.

Each tracking circuit ordinarily has a single set of sensors, typically a light source and a cooperating photocell, which sense the presence of an approaching envelope and provide an alert signal to the tracking circuit. If successive sets of sensing elements are relatively close together (i.e. ten inches or less) and the envelopes are generally consistent in length, this type of sensing system is satisfactory. However, under less desirable conditions such as handling of envelopes as short as five inches with sensing elements spaced twelve inches apart or more, two envelopes can be fed so closely together that they are not distinguished. Inaccurate data is then produced by the tracking system, and the effectiveness of the sorting operation is reduced accordingly.

The present invention provides an improved tracking system having as its primary goal the elimination of these and other problems.

More specifically, it is an object of the invention to provide, in a high volume mail sorting machine, an envelope tracking and control system that operates to activate each solenoid for only a predetermined time interval after which the solenoid is automatically deenergized. This feature is achieved by utilizing a retriggerable "one shot" circuit that energizes the corresponding solenoid for a limited time period (approximately $\frac{1}{4}$ second) which is short enough to avoid damage to the circuit components and yet long enough to permit even the longest envelopes to pass without being trapped due to premature closure of the gate. The possibility of false triggering is eliminated through the use of a delay circuit in the form of a pair of inverters and a capacitor that disable the one shot trigger function long enough to permit the associated lines to settle. The one shot function assures that the solenoid will not be energized long enough to cause damage, even in a jam situation, and at the same time permits the data to be indefinitely retained for viewing on the LED display included in the machine.

Another object of the invention is to provide an envelope tracking and control system that can be quickly and easily tested without the need for additional complicated circuitry. The test system efficiently uses hardware already existing in the control circuit. In the test mode of operation, the system is repetitively clocked simply by properly positioning a series of dip switches. This effects a complete test of the tracking circuit to determine the operability of the various components and pinpoint any areas of malfunction.

A still further object of the invention is to provide, in an envelope tracking and control system of the character described, a sensing arrangement that is adapted to employ either a double photocell system or a single photocell system. Since the tracking circuit is constructed in a manner making it compatible with both single and double photocell sensing systems, its versatility is increased. Switching between the single and double photocell modes of operation is accomplished by operating a single dip switch.

Other and further objects of the invention, together with features of novelty appurtenant thereto, will appear in the course of the following description.

DETAILED DESCRIPTION OF THE INVENTION

Figure 1:
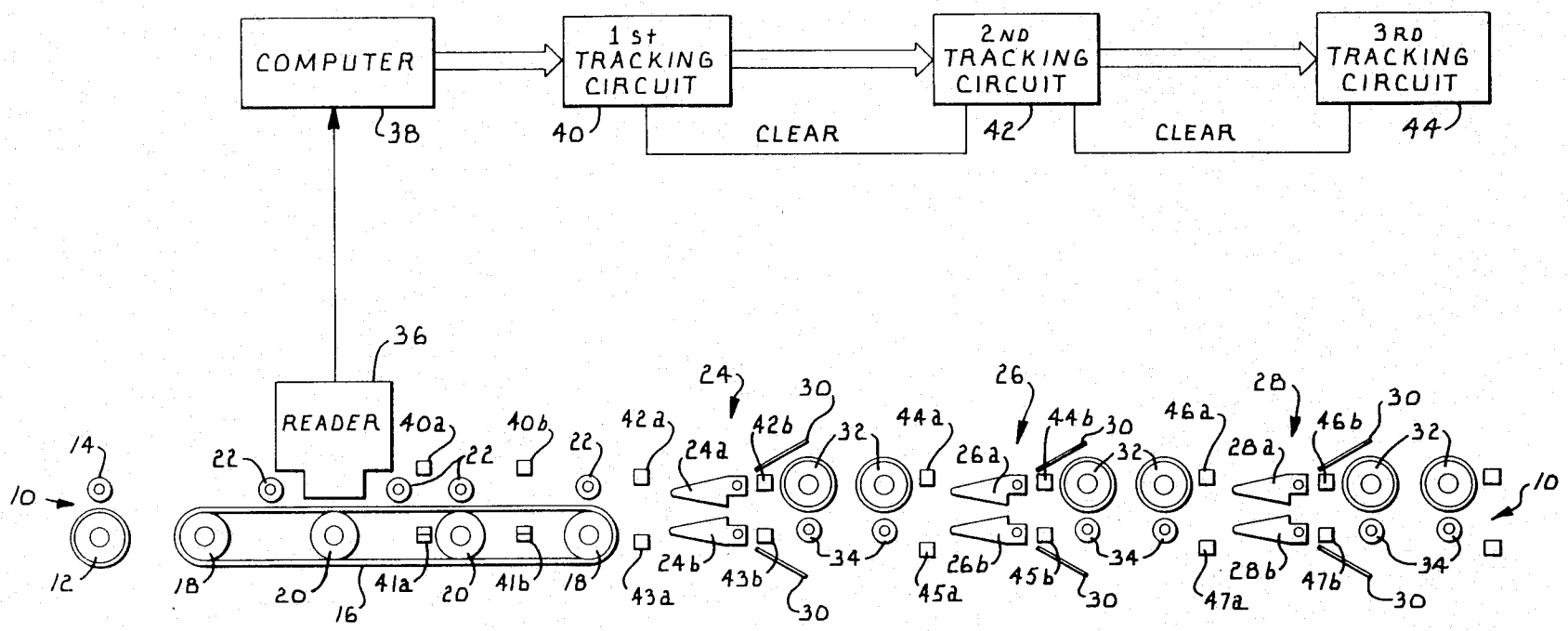
Figure 2:
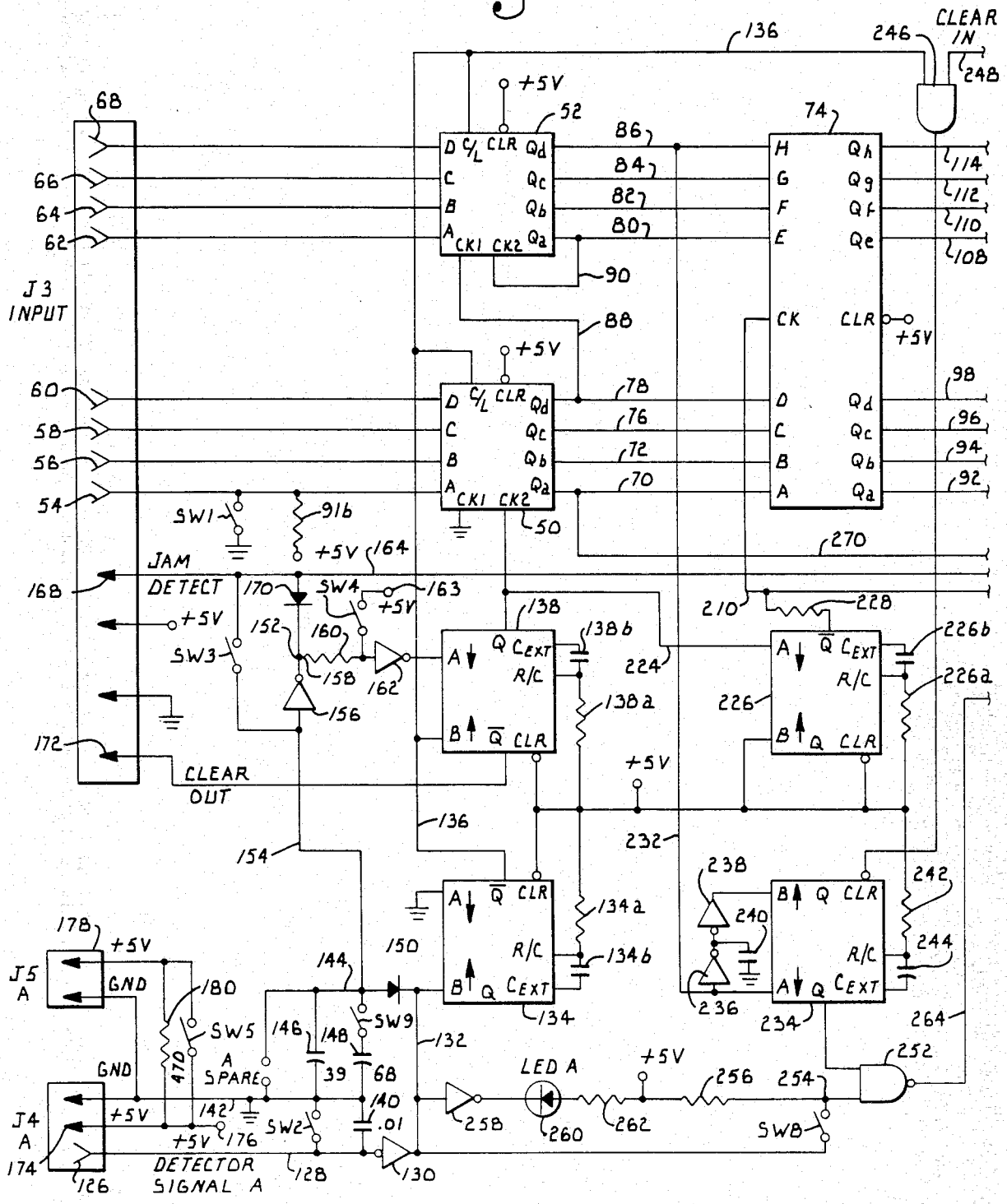
Figure 2A:
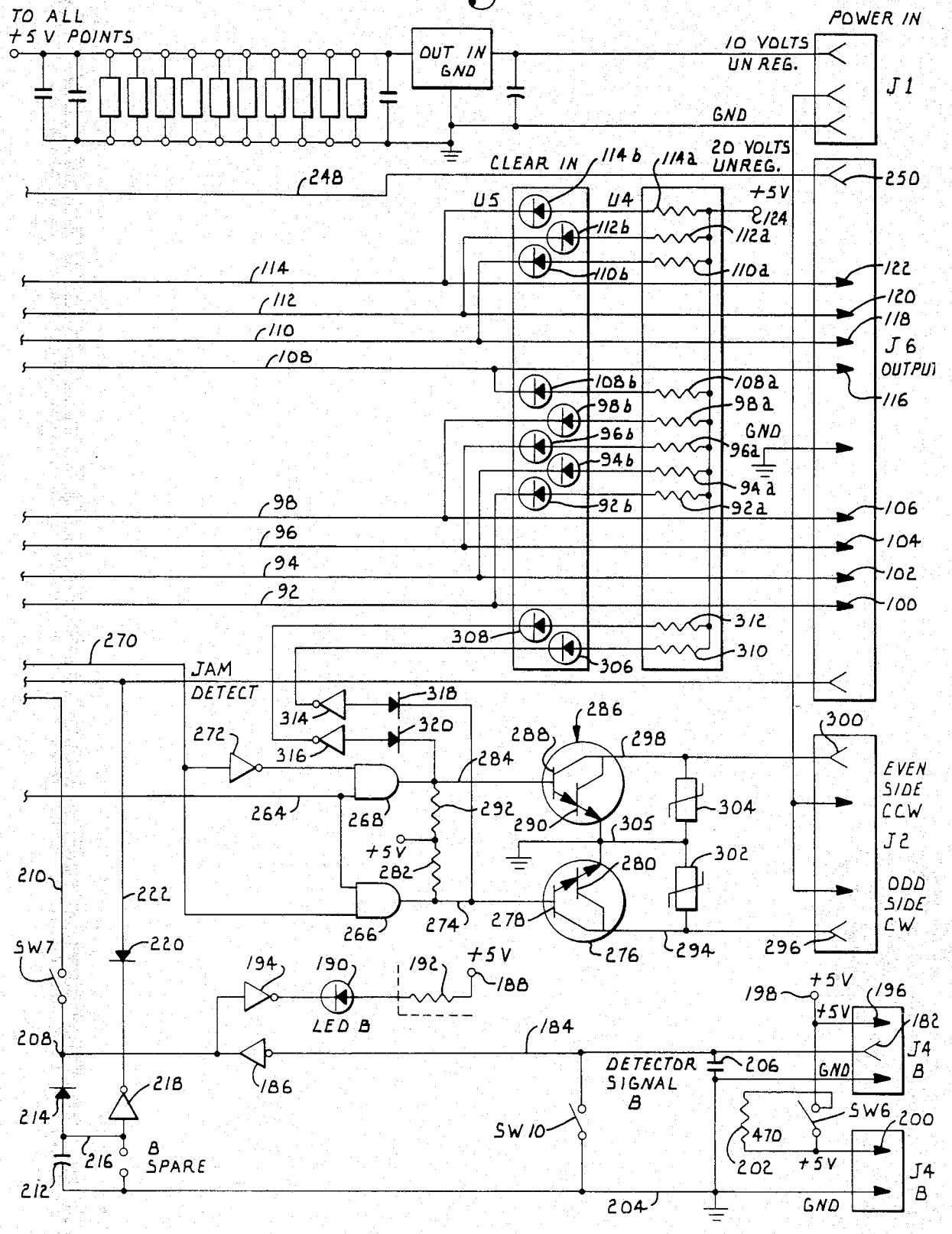

In the accompanying drawings which form a part of the specification and are to be read in conjunction therewith and in which like reference numerals are used to indicate like parts in the various views:

FIG. 1 is a schematic diagram showing a mail sorting machine equipped with an electronic tracking system constructed according to a preferred embodiment of the present invention; and FIGS. 2 and 2*a* together constitute a detailed schematic diagram of one of the tracking circuits included in the envelope tracking system.

Referring now to the drawings in more detail and initially to FIG. 1, a mail sorting machine provides an envelope guideway or path 10 along which envelopes that are to be sorted are serially transported. The envelopes are fed one at a time between a drive roller 12 and an opposing pinch roller 14 which feed the envelopes toward a conveyor belt 16. The conveyor belt 16 is drawn around a pair of driven pulleys 18 which move the front run of the belt away from the drive roller 12 and pinch roller 14. A pair of idler pulleys 20 maintain the front run of the belt in the proper position along one side of the envelope path 10. Opposing the front run of the conveyor belt are four idler rollers 22 which hold the envelopes against the conveying surface of the belt.

At the downstream end of the conveyor belt 16, a plurality of diverter mechanisms 24, 26 and 28 are positioned in series. Diverter 24 includes a pair of gates 24*a* and 24*b* located on opposite sides of the envelope path 10, and the other diverters 26 and 28 similarly include pairs of gates 26*a* and 26*b* and 28*a* and 28*b*, respectively. Each gate is shown in its normal position permitting an envelope to pass along path 10 between the gates in each pair. Each of the gates is provided with a solenoid (not shown) which controls its position. When the solenoid for a particular gate is energized, the gate is deflected inwardly to a position wherein it intercepts an envelope that is being transported along the envelope path 10. The deflected gate diverts the envelope off of the envelope path 10 and directs it against a guide plate 30 which in turn deposits the envelope in a sort bin (not shown) associated with the deflected gate.

The envelopes are conveyed from one diverter mechanism to the next diverter mechanism by a pair of drive rollers 32 and opposing pinch rollers 34. The drive rollers 32 and pinch rollers 34 are located on opposite sides of the envelope path 10 in order to convey the envelope from one set of gates to the next set of gates.

On the side of the envelope path 10 opposite conveyor belt 16, a reader 36 is positioned. The reader 36 operates in a well known manner to scan each envelope and read sorting information imprinted thereon. For example, the sorting information can be representative of the zip code of outgoing envelopes or it may be representative of the various departments of an organization receiving incoming mail. The reader device 36 is typically a magnetic reading device capable of reading a magnetic code imprinted on each envelope. Alternatively, it may be an electrooptical reader capable of using light to read a bar code imprinted on the envelope. It is to be understood that other types of readers may also be used.

A computer 38 receives the sorting information obtained by the reader 36. The computer is programmed to convert the information into a coded designation signal that indicates which of the sort bins the envelope is to be routed to. Each designation signal has a location portion in the form of a binary coded number representative of one of the diverter mechanisms of the machine and an additional bin digit which designates one of the two sort bins associated with each diverter mechanism.

The encoded designation signal is applied by the computer to an envelope tracking and control system which includes a plurality of serially arranged tracking circuits 40, 42 and 44. The first tracking circuit 40 controls the first pair of gates 24*a* and 24*b*. The second and third tracking circuits 42 and 44 control the gates of the second and third diverters 26 and 28, respectively.

Each tracking circuit is also provided with a sensing system which senses the approach of an envelope toward the corresponding diverter and provides to the tracking circuit an alert signal indicating the approach of an envelope. The sensing system for the first tracking circuit 40 includes a pair of photocells 40*a* and 40*b* that normally receive light from corresponding light sources 41*a* and 41*b*. The sensing elements associated with the second tracking circuit 42 similarly take the form of a pair of photocells 42*a* and 42*b* and cooperating light sources 43*a* and 43*b*. The third tracking circuit 44 includes photocells 44*a* and 44*b* and light sources 45*a* and 45*b*. Each set of sensing elements is located well upstream of the corresponding diverter mechanism. Each photocell is located on the opposite side of the envelope path 10 from the corresponding light source. Each time an envelope passes between a pair of sensing elements, the beam of light emitted by the light source is intercepted and does not reach the corresponding photocell. Photocells 40*a* and 40*b* are spaced approximately six inches apart, as are the pairs of photocells in the other sets. An additional set of photocells 46*a* and 46*b* and light sources 47*a* and 47*b* are included in a fourth tracking circuit (not shown) which is arranged in series with the remaining tracking circuits. It is to be understood that any desired number of tracking circuits and diverters can be provided.

The general operation of the mail sorting machine involves feeding of envelopes one at a time into the envelope path 10 between guide roller 12 and pinch roller 14 which convey the envelopes onto the front run of the conveyor belt 16. The conveyor belt, in cooperation with the idler rollers 22, transports each envelope past reader 36 which scans the envelope and reads the sort information imprinted thereon. The sort information is transferred to computer 38 and decoded and processed to provide a coded bin designation signal representative of the sort bin into which the envelope is to be deposited.

As previously indicated, the bin designation signal includes a location portion indicative of the corresponding diverter mechanism and a bin digit which is a single logic bit having a logic state representative of one of the deflecting gates of the designated diverter mechanism. The location portion of the designation signal is a binary coded number having a numerical value which is a preselected number of counts away from a set maximum number, with the number of counts corresponding to the relative position of the designated diverter. For example, a difference of one count indicates that the envelope is to be diverted by one of the gates in the first diverter mechanism 24, while a difference of two counts indicates that the envelope is to be diverted by one of the gates of the second diverter mechanism 26, etc. The bin digit is a binary number (zero or one).

As will be explained more fully, when the envelope reaches the diverter mechanism corresponding to the location portion of the bin designation signal, the solenoid is energized for the gate in the designated diverter corresponding to the bin digit. The energized solenoid deflects the gate in a manner to intercept the envelope and divert it into the sort bin corresponding to the deflected gate. In this manner, each envelope is deposited into the sort bin corresponding to the coded information imprinted onto the envelope.

Referring now to FIG. 2, each tracking circuit of the envelope tracking system includes a pair of programmable digital counting circuits 50 and 52. Each counting circuit actually includes two separate counters having distinct input, output and clock terminals. The first counter incorporated in each circuit 50 and 52 is a one bit counter which utilizes input pin A, output pin Qa and the clock input identified by CK1. Each input pin A presets the count state of the counter, while each output pin Qa provides an output signal representative of the present count state of the counter. The CK1 input increments the count state when a clock signal is applied to it.

Each of the counting circuits 50 and 52 also includes a second counter in the form of a three bit counter utilizing input pins B, C and D and output pins Qb, Qc and Qd. The input pins preset the count state, with the least significant bit represented by input pin B and the most significant bit represented by pin D. The output pins provide an output signal representative of the presence count state of the counter, and the clock input CK2 increments the count state each time a clock pulse is received.

Each counting circuit 50 and 52 has a single clear input CLR and a load input C/L. When a load signal is applied to the C/L input, the binary numbers present at the input pins are loaded into the counters. The clear input CLR of each counter is an inverted input connected with +5 volts.

Input terminals 54, 56, 58 and 60 of the tracking circuit are connected with the respective input pins A, B, C and D of counting circuit 50 while additional input terminals 62, 64, 66 and 68 connect with the respective input pins A, B, C and D of circuit 52. The Qa and Qb output pins of circuit 50 are connected by lines 70 and 72 with the respective A and B input pins of an octal latch circuit 74 having its C and D input pins connected with the Qc and Qd pins of circuit 50 by lines 76 and 78, respectively. The Qa and Qb output pins of circuit 52 are connected with the E and F input pins of latch 74 by lines 80 and 82, while lines 84 and 86 connect the Qc and Qd pins of circuit 52 with the G and H input pins of latch 74. The Qd output pin of counting circuit 50 is connected by line 88 with the CK1 pin of counting circuit 52. The CK2 pin of circuit 52 is connected by line 90 with the Qa output pin. By this arrangement, a single counting circuit is formed by the second counter of circuit 50 and the two counters of circuit 52. The first counter of circuit 50 provides the single bin digit, and its CK1 pin is connected with ground to prevent incrementing of the bin digit.

Input line 54 is connected with ground through a dip switch SW1. Line 54 is connected with a +5 volt terminal 91*a* through a resistor 91*b*.

The latch circuit 74 has Qa, Qb, Qc and Qd outputs corresponding the to A, B, C and D inputs. These output pins of the latch circuit are connected by lines 92, 94, 96 and 98 with respective output terminals 100, 102, 104 and 106 of the tracking circuit (see FIG. 2*a*). The latch circuit also has output pins Qd, Qf, Qg and Qh corresponding to the E, F, G and H input pins and connected by lines 108, 110, 112 and 114 with respective output terminals 116, 118, 120 and 122 of the tracking circuit. The clear terminal CLR of latch circuit 74 is an inverted terminal connected with +5 volts. The input terminals of the tracking circuit receive signals from the previous tracking circuit, and the output terminals pass on signals to the next tracking circuit when clocked through the latch.

With continued reference to FIG. 2*a*, +5 volts is provided to a terminal 124 which connects with line 92 through a resistor 92*a* and an LED 92*b*, with line 94 through a resistor 94*a* and an LED 94*b*, with line 96 through a resistor 96*a* and an LED 96*b*, and with line 98 through a resistor 98*a* and an LED 98*b*. Similarly, terminal 124 connects with line 108 through a resistor 108*a* and an LED 108*b*, with line 110 through a resistor 110*a* and an LED 110*b*, with line 112 through a resistor 112*a* and an LED 112*b*, and with line 114 through a resistor 114*a* and an LED 114*b*. The LEDs provide a visual display of the data present on the output lines of the latch circuit 74.

The first or 'A" pair of photo sensors for each tracking circuit are connected with an alert signal input terminal 126 of the tracking circuit which is in a high state unless an envelope is positioned between the photo sensors. Terminal 126 is connected with a detector signal A line 128 which leads to the input of an inverter 130. The output from inverter 130 is applied to a conductor 132 leading to the B input pin of an integrated circuit 134 having its $\overline{Q}$ output pin connected by line 136 with the C/L load input pins of circuits 50 and 52 and with the B input pin of a circuit 138 that serves to clock the CK2 pin of counting circuit 50. The CLR pins of circuits 134 and 138 are inverted inputs connected with +5 volts. The R/C and Cext pins of circuits 134 and 138 are connected with +5 volts through resistors 134*a* and 138*a* and capacitors 134*b* and 138*b*.

A capacitor 140 is connected between the detector signal line 128 and a ground line 142 and is arranged in parallel with switch SW2 which is likewise connected between lines 128 and 142. Connected between the ground line 142 and another line 144 is a 39 microfarad capacitor 146. Also connected between lines 142 and 144 in parallel with capacitor 146 is a 68 microfarad capacitor 148 and a dip switch SW9 in series with capacitor 148. Line 144 is connected with line 132 through a diode 150.

Extending between line 144 and a node 152 is a conductor 154 which is provided with a jam detect inverter 156. Extending from node 152 to the A input pin of circuit 138 is a conductor 158 having a resistor 160 and an inverter 162. A +5 volt terminal 163 is connected with line 158 between resistor 160 and inverter 162 by a dip switch SW4. A jam detect line 164 has an input terminal 166 (FIG. 2*a*) and an output terminal 168 (FIG. 2). The jam detect line is common to all of the tracking circuits in the system and is normally in a high state. When the jam detect line 164 is in a low state, an indication is provided that there is an envelope jammed in the machine. A dip switch SW3 connects the jam detect line 164 with line 154 and with the input to inverter 156. A diode 170 is connected between line 164 and node 152. The $\overline{Q}$ output pin of circuit 138 connects with a clear output terminal 172 which provides a clear signal to the preceding tracking circuit.

The power input to the detector signal line 128 is provided at terminal 174 which connects with a terminal 176 receiving +5 volts. Plus 5 volts is also applied to another terminal 178 that connects with terminal 174 through a resistor 180. Arranged in parallel with resistor 180 is a dip switch SW5 which can be closed to short the resistor 180 in order to increase the voltage applied to the detector signal circuit.

Referring now to FIG. 2*a* in particular, the tracking circuit has a second alert signal input terminal 182 connected with the second or B set of photo sensors located downstream of the A set of sensors. Extending from terminal 182 is a detector signal B line 184 having an inverter 186. A terminal 188 which receives +5 volts is connected with an LED 190 through a resistor 192. The detector signal B line 194 is connected with the other terminal of the LED 190 through an inverter 194. When the output of inverter 194 is in a low state, the LED 190 is energized to provide a visual indication that the B set of photocells is blocked by an envelope.

A power input terminal 196 to the alert signal terminal 182 is connected with a terminal 198 that receives +5 volts. Another terminal 200 to which plus 5 volts is applied is connected with terminal 196 through a resistor 202. A dip switch SW6 is arranged in parallel with resistor 202 in order to short circuit the resistor upon closing of switch SW6.

Connected between the detector signal line 184 and a ground line 204 is a capacitor 206. A dip switch SW10 is connected between lines 184 and 204 in parallel with the capacitor 206.

Line 184 connects with a node 208 from which a conductor 210 extends to the clock input CK (see FIG. 2) of the latch circuit 74. Line 210 includes a dip switch SW7. Connected between the ground line 204 and node 208 are a capacitor 212 and a diode 214. From a location between the capacitor 212 and diode 214, a conductor 216 estends to the input side of an inverter 218. The output side of inverter 218 connects with a diode 220 having its opposite side connected with a conductor 222 that extends to the jam detect line 164.

Referring again to FIG. 2, the Q output pin of circuit 138 is connected by line 224 with the A input pin of an integrated circuit 226 which serves to clock the latch 74 when switch SW7 is open. The $\overline{Q}$ output pin of circuit 226 is connected through a resistor 228 with line 210. Plus 5 volts is applied to the B input pin and the inverted CLR pin of circuit 226. Plus 5 volts is also applied to the R/C pin of circuit 226 through a resistor **226*a* and to the Cext pin through resistor 226*a* and a capacitor 226*b***.

The Qd output line 86 of counting circuit 52 is connected with a line 232 that leads to the A input pin of an integrated circuit 234. Line 232 also connects with the B input pin of circuit 234 through a delay circuit formed by a pair of inverters 236 and 238 and a capacitor 240. The output of inverter 236 and the input of inverter 238 are connected with system ground through the capacitor 240. The delay circuit provide a time delay of approximately 1 microsecond between the input signals applied to the A and B pins of circuit 234. Plus 5 volts connects with the R/C pin of circuit 234 through a resistor 242 and with the Cext pin through resistor 242 and a capacitor 244.

The inverted clear input CLR of circuit 234 connects with the output of an AND gate 246. Line 136 provides one input to gate 246, and the other input is provided by a clear in line 248. Line 248 connects with a clear input terminal 250 (FIG. 2*a*) that connects with the clear out terminal of the next successive tracking circuit.

The Q output pin of circuit 234 provides one input to an AND gate 252. The other input to gate 252 is applied from a node 254 that is connected with +5 volts through a resistor 256 and with the output of inverter 130 when a dip switch SW8 is closed. An inverter 258 has its input side connected with line 132 and its output side connected with an LED 260. The opposite side of LED 260 is connected with +5 volts through a resistor 262.

AND gate 252 has an output line 264 providing one input to each of a pair of AND gates 266 and 268. The other input to gate 266 is applied on a conductor 270 that extends from the Qa output line 70 of counting circuit 50. Line 270 is connected with the second input of gate 268 through an inverter 272.

AND gate 266 has an output line 274 leading to a composite amplifier 276 formed by a pair of transistors 278 and 280 arranged in a Darlington configuration. Plus 5 volts is connected with line 274 through a resistor 282 to properly bias the amplifier.

AND gate 268 has an output line 284 extending to a similar composite amplifier 286 formed by a pair of transistors 288 and 290 arranged in a Darlington configuration. Line 284 is connected with +5 volts through a resistor 292 to properly bias amplifier 286.

The output line 294 of amplifier 276 leads to a terminal 296 that connects with the solenoid for one of the gates associated with the tracking circuit. The output line 298 of the other amplifier 286 connects with another terminal 300 used to drive the solenoid for the other gate. The output lines 294 and 298 are connected with system ground through respective variable resistors 302 and 304 and line 305. The emitters of transistors 280 and 290 are likewise connected with ground through line 305.

The visual LED display or the tracking circuit includes a pair of LEDs 306 and 308 which correspond with the solenoids that connect with the respective terminals 296 and 300. Plus 5 volts are applied to the LEDs 306 and 308 through resistors 310 and 312, respectively. The LEDs connect on their opposite sides with the output sides of inverters 314 and 316. The input side of inverter 314 is connected with one side of a diode 318 having its opposite side connected with line 274. Similarly, the input side of inverter 316 connects with one side of a diode 320 having its opposite side connected with line 284.

In normal operation of the mail sorting machine, the envelopes that are to be sorted are fed one at a time between the drive roller 12 and pinch roller 14. Each envelope is delivered from these rollers to the conveyor belt 16 which, in cooperation with the idler rollers 22, conveys the envelope past the reader 36. The reader scans the envelope and reads the sorting information imprinted thereon. The sort information is transferred to the computor which decodes it and processes the data to produce a coded bin designation signal representative of the sort bin to which the envelope is to be routed.

As previously indicated, the bin designation signal includes a location portion which is delivered initially to the first tracking circuit as a binary coded number appearing at terminals 56–68. The bin digit is transferred to the first tracking circuit as a single logic bit (high or low) appearing at input terminal 54.

As the envelope is conveyed between the initial pair of photo sensors **40*a* and 41*a*, the alert signal input terminal 126 for the first tracking circuit goes from its normally high state to a low state. As the detector signal on line 128 goes low, the B input to circuit 134 rises correspondingly due to the inverter 130. The Q output of circuit 134 goes to a low state until line 132 stabilizes, thus providing a low pulse on line 136. The output of AND gate 246 then goes low to clear circuit 234**.

At the end of the low pulse on line 136, circuit 138 provides a high pulse on its Q output line which is applied to the CK2 clock input of counting circuit 50. The pulse applied to the C/L load pin of each counting circuit 50 and 52 causes the data on lines 54–68 to be loaded into the corresponding inputs of the counting circuits, and the clock pulse applied to the CK2 input of circuit 50 causes the existing count state to be incremented and loaded into the latch circuit 74. It is noted that the CK1 clock pin of the first counting circuit 50 is grounded so that the bin digit which is provided to input pin A is not incremented and remains unchanged at output pin Qa. The second counter of circuit 50 and both counters of circuit 52 are connected in series, as previously indicated, to provide essentially a single counting circuit having a clock input at the CK2 pin of circuit 50.

The data that is thus loaded into the octal latch circuit 74 represents a binary number at pins B–H corresponding to the location portion of the incremented signal and a single digit binary number at pin A representing the sorting bin to which the envelope is to be delivered. When the high output signal on the Q pin of circuit 138 terminates, the $\overline{Q}$ pin provides a clear signal on terminal 172 to the preceding tracking circuit.

When the detector signal A line 128 is in a low state indicating that the corresponding photo sensors are blocked by an envelope, the input to inverter 258 is in a high state, and the inverter output is low in order to energize LED 260. The light provided by LED 260 gives a visual indication on the display panel that the photo sensors 40*a* and 41*a* are blocked.

As belt 160 conveys the envelope between the next pair of photo sensors 40*b* and 41*b*, the other alert signal terminal 182 goes to a low state. The low state of the detector signal B line 184 is inverted by inverter 186 and appears as a high signal at node 208 and the input to inverter 194. The output of inverter 194 thus goes low in order to energize LED 190, thereby providing a visual indication on the display panel that photo sensors 40*b* and 41*b* are blocked.

If dip switch SW7 is closed (as it is for a double photocell system), line 210 is in a high state and provides a clock input at the CK pin of latch 74. Then, the data appearing at the latch circuit inputs is passed through the latch circuit to the corresponding outputs and to the output terminals 100–106 and 116–122. The data on the output terminals, which represents the incremented data, is delivered to the input terminals of the next tracking circuit.

Each line 92–98 and 108–114 which is in a low state causes the corresponding LED on the display panel to energize. This provides a visual indication of the state of the output lines.

When the Qd output line 86 of counting circuit 52 is in an active state, indicating coincidence between the incremented count state and the maximum count state of the counting circuitry, line 232 is active. After all other signals have settled and stabilized, the dropping digital signal on line 232 applied to the input pin A of circuit 234 generates a high signal on the Q output pin. The Q output signal is a momentary "one shot" high pulse which is applied to the AND gate 252. Since the other input to gate 252 is high, a high output pulse is provided on line 264 to both AND gates 266 and 268. The other input to one of the gates 266 and 268 will also be high, depending on the logic state of the bin digit signal on line 270. If line 270 is in the high state, gate 266 will be activated, making its amplifier 276 conductive to energize the solenoid connected with terminal 296. The gate operated by the energized solenoid is then deflected to intercept the envelope and divert it into the sorting bin corresponding to the deflected gate. If line 270 is low, AND gate 268 is activated, and the solenoid connected with terminal 300 is then energized to deflect its gate in a manner to divert the envelope into the sorting bin associated with the deflected gate.

In this manner, the envelope is routed into the appropriate sorting bin if there is coincidence between the incremented signal and the code assigned to the diverter mechanism. In the event of such coincidence, it is not necessary for the data to be clocked through latch 74, and the appropriate gate will be deflected whether or not the latch circuit is clocked. If there is no coincidence, the data is clocked through the latch and loaded into the subsequent tracking circuit only if the B photo sensors are blocked to activate the clock input of the latch circuit. Since the sets of photo sensors are located approximately six inches downstream of one another, two separate pieces of mail can block two sets of photo sensors only if they are spaced less than six inches apart from leading edge to leading edge and the leading piece is between five inches and six inches long. This situation is extremely unlikely to occur in actual practice, and the double photocell system thus assures that the sorting equipment will function in the intended manner for effective mail sorting.

The delay circuit formed by inverters 236 and 238 and capacitor 240 provides a delay of approximately one microsecond between the A and B inputs to circuit 234. Accordingly, the delay circuit assures that the Q output will not be falsely triggered by a rising clear signal when there is a preset low signal on line 232. This effectively disables the one shot trigger function for approximately one microsecond, thus allowing more than enough time for all associated lines to settle. The delay circuit has no effect on the output pulse Q which is cleared by a low signal appearing at the clear pin CLR. It is noted that the Q output of circuit 234 is in a logic high state for a period which is determined by resistor 242 and capacitor 244. Preferably, the values for these circuit components are selected such that the one shot pulse has an "on" time of approximately $\frac{1}{4}$ second which is short enough to prevent any damage to the solenoids or other components and long enough for an envelope 11 inches long to pass through the machine without being prematurely trapped due to closure of the deflected gate.

The tracking circuit is equally useful with a single photocell system. In this event, switch SW7 is open, and the latch 74 is automatically clocked by the $\overline{Q}$ output pin of circuit 226. Each time the high signal at the Q output pin of circuit 138 terminates, the $\overline{Q}$ output of circuit 226 applies a clock pulse to line 210 which is in turn applied to the clock input of latch 74 to pass data through the latch. It is noted that automatic clocking occurs at the $\overline{Q}$ output pin of circuit 226 in a single photocell system, but this clocking is suppressed in the double photocell system due to the closure of switch SW7. The provision of circuit 226 thus makes the tracking circuit applicable both to single and double photocell systems.

In normal operation, switches SW1, SW2 and SW3 are open and switch SW4 is closed to prevent double clocking of circuit 138 in a jam situation, as will be explained more fully. Switches SW5 and SW6 can be either open or closed. When closed, these switches increase the intensity of emitters "A" and "B", respectively, by short circuiting resistors 180 and 202. As previously indicated, switch SW7 is closed for a double photocell system and open for a single photocell system.

Switch SW8 can be closed to effect a high input to gate 252 only when the A photo sensors are blocked to provide a low at terminal 126. When the envelope has cleared photo sensors A, an energized solenoid is deenergized at that time due to the low input then applied to gate 252. When switch SW8 is open, an energized solenoid is deenergized by a clear in signal on line 248. When switch SW8 is closed, an energized solenoid is deenergized when the trailing edge of an envelope clears the A set of photo sensors to provide a high signal on line 128 and a low input to gate 252.

Switch SW10 is open in normal operation, and switch SW9 can be closed to effect a longer jam detect time delay, as will be explained.

The normally high jam detect line 164 is common to all of the tracking circuits in the system and, when in the low state, provides an indication that an envelope is jammed in the machine. When an envelope is jammed to constantly block photocells A, there is a constant low on the detector signal A line 128. Line 132 is then constantly high to reverse bias diode 150, thus permitting capacitor 146 to charge (along with capacitor 148 if switch SW9 is closed). When capacitor 146 (or 148) becomes adequately charged, the positive charge is applied to the input of the jam detect inverter 156. In other words, the inverter interprets the signal as a logic high (approximately 1.9 volts) on line 154, and the inverter output goes low. This pulls the jam detect line 164 low through diode 170, thereby providing an indication of a jammed enevelope in the machine.

If the B set of photo sensors is blocked by an envelope, the jam detect line 164 is pulled low in essentially the same manner. The constant low applied to line 184 is inverted by inverter 186 and effects reverse biasing of diode D4. Capacitor 212 is then permitted to charge, and inverter 218 interprets such charging as a high signal on its input line 216. Inverter 218 then provides a low output signal which pulls the jam detect line 164 low through diode 220 to provide an indication of a jammed envelope.

The circuitry can be checked for operability by placing the dip switches in the self test position. In the test mode, switches SW2, SW3 and SW10 are closed and switch SW4 is open. Closing of switch SW2 connects terminal 126 with ground to simulate blocking of the A photo sensors, while closing of SW10 similarly connects terminal 182 with ground to simulate blocking of the B photosensors. LEDs 190 and 260 are energized to indicate the blocked condition of the photo sensor pairs. Closing of switch SW2 also disables the data operation, thus allowing the circuitry to count during the self test operation.

When switch SW3 is closed, the high signal on the jam detect line 164 is applied to the input of inverter 156, thus tending to produce a low signal at node 152. A low at node 152 tends to pull the jam detect line 164 low through diode 170, thereby tending to produce a low at the input of inverter 156. Due to the effect of the inverter hysteresis, the effects of its input impedence, and the effect of the jam detect time capacitors 146 (and 148 when switch SW9 is closed), an astable oscillator circuit is provided, and an oscillating signal is produced at node 152. When voltage of approximately 1.9 volts has been applied to the input of inverter 156 to provide a low output, the output will not change until the input drops below a lower voltage level (typically 1.2 volts). Consequently, a short circuit through diode 170 from the output to input causes oscillations at a "time to jam" detect rate which is coincidental with the optimum rate for viewing changing logic states from the output of the counters on the LED display panel. Due to the presence of diode 170, the high state of the inverter output will not tend to charge 146 (or 148), yet the capacitors will discharge when the output of the inverter is low.

The oscillating signal produced at node 152 is processed through inverter 162 and applied to the A pin of circuit 138. The negative edges of the clock pulses thereby applied to circuit 138 provide appropriate output pulses in synchronization on the Q output pin and on the CK2 pin of circuit 50. These pulses cause the counting circuits 50 and 52 to ripple count and also trigger pin A of circuit 226 which in turn clocks latch 74 after the outputs from the counting circuits have settled. In the self test mode, switch SW1 can be closed (before switch SW2 is closed) to permit activation of the solenoid connected with terminal 300 (the "even side" solenoid). When switch SW9 is closed, capacitor 148 is brought into the jam detect timing circuit and increases the jam detect time delay as compared to the condition in which switch SW9 is open and only capacitor 146 is in the circuit.

AND gate 246 is inactive if either line 136 or the clear in line 248 is in a low state. In this condition, gate 246 provides a low output signal which effects clearing of circuit 234. A pulse to the clear output terminal 172 is provided from the $\overline{Q}$ pin of circuit 138.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. In a mail sorting machine having a conveyor for transporting envelopes along an envelope path, a plurality of gates for diverting the envelopes off of said path control circuitry for comparing data indicative of each envelope with preassigned data corresponding to each gate approached by the envelope, means for controlling each gate in a manner to divert an envelope off of said path in the event of coincidence between the data indicative of the envelope and data corresponding to the gate, a clock controlled circuit included in said control circuitry for initiating same, and sensing means for normally applying a clock pulse to said clock controlled circuit upon approach of an envelope toward a gate, the improvement comprising:

first switch means for disabling said sensing means in a test position, said first switch means having a normal position wherein the sensing means is enabled;

an astable oscillator for applying test clock pulses to said clock controlled circuit in a test mode of operation to simulate envelopes successively approaching the gates; and second switch means having a normal position disconnecting said oscillator from the clock controlled circuit and a test position connecting said oscillator with the clock controlled circuit to apply test clock pulses thereto in the test mode, whereby in the normal position of said first and second switch means said clock controlled circuit is clocked by envelopes successively approaching the gates and in the test position of said first and second switch means said oscillator applies to the clock controlled circuit test clock pulses simulating envelopes successively approaching the gates.

2. The improvement set forth in claim 1, wherein said oscillator includes:

a jam detect line having a normally high state and providing in a low state an indication of an envelope jammed in the machine;

a signal inverter having input and output sides with opposite logic states, said output side of the inverter being connected with said clock controlled circuit;

a capacitor connected with the input side of said inverter;

a first diode connecting said jam detect line with the output side of said inverter in a manner to effect the low state of the jam detect line when the output side of said inverter is in a low state;

a second diode connected with said capacitor to normally prevent charging of the capacitor; and means for connecting said sensing means with said second diode in a manner to effect charging of the capacitor when said sensing means senses a jammed envelope, said capacitor when charged applying the charge to the input side of said inverter to effect a low state on the output side of the inverter and on the jam detect line to provide an indication of a jammed envelope.

3. The improvement set forth in claim 2, wherein said second switch means includes:

one switch preventing pulses on the output side of said inverter from reaching the clock controlled circuit in the normal position and permitting pulses on the output side of said inverter to reach the clock controlled circuit in the test position; and another switch connecting the jam detect line with the input side of said inverter in the test position and disconnecting the jam detect line from the input side of said inverter in the normal position, whereby said test clock pulses appear on the output side of said inverter and are applied to the clock controlled circuit in the test mode of operation.

4. The improvement set forth in claim 3, wherein said first switch means includes a switch having a normal position enabling said sensing means and conditioning said second diode to prevent charging of said capacitor and a test position disabling said sensing means and permitting charging of said capacitor.

5. In a mail sorting machine having a conveyor for transporting envelopes along an envelope path and a plurality of serially arranged diverters each capable of diverting envelopes off of said path for sorting of the envelopes, the improvement comprising:

a first set of envelope sensors for each diverter located generally along said envelope path and providing a first alert signal upon the approach of an envelope toward the diverter;

circuit means for each diverter receiving said first alert signal and responding thereto by effecting a comparison between data indicative of the approaching envelope and preassigned data corresponding to the diverter being approached by the envelope;

means for controlling each diverter in a manner to divert the approaching envelope off of said path in the event of coincidence between data indicative of the approaching envelope and the preassigned data corresponding to the diverter;

a second set of sensors for each diverter located downstream from the first set of sensors and providing a second alert signal upon the approach of an envelope toward the diverter; and means for receiving said second alert signal and responding thereto by effecting transfer of the data indicative of the envelope to the circuit means for the next diverter approached by the envelope.

6. The improvement set forth in claim 5, including:

means for disabling said second set of sensors to prevent application of said second alert signal to said receiving means; and means responsive to said first alert signal for applying to said receiving means a signal simulating said second alert signal when said second set of sensors is disabled, thereby effecting transfer of the data indicative of the envelope to the circuit means for the next diverter approached by the envelope.

7. In a mail sorting machine having a conveyor for transporting envelopes along an envelope path and a plurality of serially arranged diverters for diverting envelopes off of said path, the improvement comprising:

first sensing means for each diverter located upstream of the diverter and operable to sense the presence of an envelope approaching the diverter;

means for providing a first alert signal in response to sensing of an approaching envelope;

circuit means for each diverter responsive to said first alert signal and operable to process data indicative of the approaching envelope and to compare the processed data with preassigned data corresponding to the diverter being approached by the envelope;

a latch circuit for receiving the processed data from said circuit means and holding the processed data, said latch circuit having a clock input and responding to the application of a signal to said clock input by transferring the processed data from the latch circuit to the circuit means for the next diverter approached by the envelope;

second sensing means for each diverter located downstream from said first sensing means and operable to sense an envelope present at said second sensing means;

means for applying a second alert signal to said clock input of the latch circuit when an envelope is sensed at said second sensing means; and control means for each diverter for controlling same in a manner to divert each approaching envelope off of said envelope path in the event of coincidence between the processed data and the preassigned data corresponding to the diverter.

8. The improvement set forth in claim 7, including:

means for disabling said applying means; and means for receiving said first alert signal and applying in response thereto a signal to said clock input of the latch circuit when said applying means is disabled, whereby the processed data is transferred from the latch circuit to the circuit means for the next diverter.

9. The improvement set forth in claim 7, wherein said applying means comprises a conductor extending to said clock input from the second sensing means, and including switch means in said conductor having a closed condition wherein the second alert signal can be applied to said clock input and an open condition wherein the second alert signal is prevented from reaching said clock input.

10. The improvement set forth in claim 9, including means for signalling said clock input of the latch circuit in response to application of said first alert signal to said circuit means, said second alert signal suppressing said signalling means in the closed condition of said switch means but not in the open condition thereof, whereby the second alert signal is applied to said clock input in the closed condition of said switch means and said signalling means applies a signal to said clock input in the open condition of said switch means to effect transfer of the processed data to the next circuit means in either condition of said switch means.

* * * * *